US005860348A

United States Patent [19]

Morse et al.

[11] Patent Number: 5,860,348

[45] **Date of Patent: *Jan. 19, 1999**

[54] APPARATUS FOR DIVIDING FROZEN FISH SLABS

[75] Inventors: Charles H. Morse; Robert R. Harrison, both of Beverly, Mass.

[73] Assignee: Pearce Processing Systems, Inc., Gloucester, Mass.

[ * ] Notice: This patent issued on a continued prosecution application filed under 37 CFR 1.53(d), and is subject to the twenty year patent term provisions of 35 U.S.C. 154(a)(2).

[21] Appl. No.: 814,915

[22] Filed: Mar. 12, 1997

[51] Int. Cl.[6] ..... B26D 3/08; B26D 7/06

[52] U.S. Cl. ..... 83/864; 83/407; 83/425.3; 83/435; 83/435.17; 83/664; 83/881; 83/882; 83/884; 452/151

[58] Field of Search ..... 83/49, 52, 407, 83/409.1, 882, 863, 864, 865, 872, 874, 876, 880, 881, 883, 884, 885, 886, 425.2, 425.3, 425.4, 508.3, 664, 665, 873, 303, 308, 435, 435.15, 435.16, 435.17; 452/142, 143, 151

[56] References Cited

U.S. PATENT DOCUMENTS

| | | | |
|---|---|---|---|
| Re. 30,324 | 7/1980 | Seme | 83/880 X |
| 390,034 | 9/1888 | Peckover | 125/13.01 |
| 1,298,520 | 3/1919 | Lawrence | 83/425.3 X |
| 2,160,221 | 5/1939 | Masters et al. | 83/884 X |
| 2,445,488 | 7/1948 | Luteran | 83/35 |
| 2,941,560 | 6/1960 | McCaffery | 83/882 |
| 3,646,418 | 2/1972 | Sterns et al. | 83/874 X |
| 3,706,251 | 12/1972 | Wheeler et al. | 83/882 X |
| 4,470,345 | 9/1984 | Miyata | 83/884 X |
| 4,934,237 | 6/1990 | Nienstedt | 83/865 |

FOREIGN PATENT DOCUMENTS

| | | | |
|---|---|---|---|
| 871 396 | 3/1953 | Germany | 83/884 |

*Primary Examiner*—Clark F. Dexter
*Attorney, Agent, or Firm*—Cesari and McKenna, LLP

[57] ABSTRACT

A method of dividing deep-frozen food blocks comprising forming a succession of spaced parallel blade rows each row having a plurality of spaced parallel coaxial freely rotatable discoid blades and advancing successive food blocks past the successive blade rows so that the blades in the successive blade rows rotate with a peripheral speed which more or less matches the speed of the block advance so that there is minimal relative linear motion of the blade edges and the blocks whereby the blades groove the blocks by displacing block material to the sides of the grooves and selecting a number of blade rows such that while the grooves made by any blade row are quite shallow, the grooves made by all of the blade rows divide each of the blocks into a plurality of parts. Apparatus for practicing the method is also disclosed.

9 Claims, 3 Drawing Sheets

APPARATUS FOR DIVIDING FROZEN FISH SLABS

FIELD OF THE INVENTION

This invention relates to method and apparatus for dividing a block or slab of a frozen food product into portions of a suitable size and shape for further processing or for eating. While the invention may have application in the production of a wide variety of food products, it is particularly suitable for making fish sticks.

BACKGROUND OF THE INVENTION

Frozen fish is usually caught, cleaned and deep frozen on board factory ships and brought ashore in an international standard 16.5 pound block or slab which measures 19×10×2.5 inches. The standard block is delivered at a temperature of −5° to +5° F. to a fish processing plant where it is subjected to a series of cutting steps to produce fish sticks or other portions of suitable size and shape for the retail and food service markets. All of the commonly available stick and portion sizes are direct derivatives of the above block dimensions and are usually produced in three cutting steps. The steps are commonly referred to in the industry as logging, slabbing and portioning, which terms describe the shape and size of the product resulting from each step. In the case of a block that is divided into fish sticks, the resulting pieces are usually about 3–4 inches long and ½–¾ inch in rectangular cross section.

There are three common techniques used in the industry to make these cuts. In the most common technique, the fish blocks are advanced by a conveyor into a band saw or multiple-band band saw which divides the block into a plurality of portions. This procedure allows for production flexibility, but, it creates a considerable yield loss in the form of sawdust. Another common technique is to advance the blocks past a rotary saw blade in a machine similar to a table saw. Here again, sawdust losses can be substantial.

There have also been developed cutting apparatus which utilize driven rotary knife blades, in lieu of saw blades, which are able to slice through the frozen fish blocks in such a way as to minimize product wastage. Examples of such apparatus are disclosed in U.S. Pat. Nos. 2,941,560 and 4,934,237. However such cutting machines whose cutting blades rotate at relatively high speed invariably require that the blades be relatively thick in order to have the lateral stability necessary to withstand the opposing forces that are developed during the cutting process. Thus the blades produce a relatively wide cutting swath through the block which can cause chipping of the product material at the cut. Also, the blades tend to be relatively expensive particularly when the blades are provided with a specially formed cutting edge or a diamond-tipped cutting edge as described in the latter patent above.

We are also aware that some high volume producers use a slicing technique which does not create any sawdust, but which requires that the fish blocks be warmed to 20° F. or more prior to cutting. This tempering step is accomplished by loading the blocks into a holding room and subjecting them to microwave energy which adds significantly to the processing cost.

Thus, until now, producers have been unable to effectively and economically divide deep-frozen fish blocks because of the hardness of the blocks.

SUMMARY OF THE INVENTION

Accordingly, it is an object of the present invention to provide a method of effectively and economically dividing deep-frozen blocks of food product such as fish, seafood, meat and the like.

Another object of the invention is to provide such a method which minimizes product wastage.

Another object of the invention is to provide improved apparatus for efficiently and effectively dividing blocks of deep-frozen food product into portions of edible size.

Yet another object of the invention is to provide apparatus of this type which has a relatively high throughput.

A further object of the invention is to provide such apparatus which suffers a minimum amount of down time.

Still another object of the invention is to provide apparatus of this type which is relatively inexpensive to make and maintain.

Other objects will, in part, be obvious and will, in part, appear hereinafter.

The invention accordingly comprises the several steps and the relation of one or more of such steps with respect to each of the others, and the apparatus embodying the features of construction, combination of elements and arrangements of parts which are adapted to effect such steps, all is exemplified in the following detailed description, and the scope of the invention will be indicated in the claims.

Briefly, in accordance with our process, successive blocks of deep-frozen food product such as fish are conveyed by conveyor means past rows of laterally spaced-apart undriven rotary discoid razor-like blades which work sequentially to cut through the frozen blocks. The blades in each row make very shallow cuts or grooves which are in line with the cuts made by the corresponding blades in the previous rows and there is a sufficient number of blade rows such that the blades together work their way entirely through the block to complete a logging, slabbing or portioning type of division.

The word "cut" as used herein is actually a misnomer because, as noted above, the blades are undriven. Consequently, as a block is moved opposite a row of blades, there is substantially no relative linear movement between the block and the blade edges at the points of contact between the two. In other words, the engagement of the block with the blades causes the blades to rotate such that the peripheral speed of the blades is more or less the same as the linear speed of the block. Thus, the "cuts" in the block are made by a deformation or embossing process whereby the block material is displaced to the sides of the shallow cuts rather than by a slicing action whereby material is removed from the blocks. As we shall see, this results in an extension of the block in a direction perpendicular to the direction of block advance.

To achieve the desired result, the blades in the successive rows of blades are mounted on undriven arbors with machined cylindrical spacers between the blades such that the blades are free to rotate as a result of contact with the blocks. Preferably, the blades in all of the rows have the same diameter. However, the arbors in the successive rows are located progressively closer to the blocks being conveyed so that the successive rows of blades cut progressively deeper into the block. The spacers between the blades of each row of blades determine the distance between adjacent cuts made by that row and provide lateral stability to the blades. Preferably, the diameter of the spacers between the blades of each blade row is maximized to provide the most lateral support for the blades comprising that row. In other words, since the successive rows of blades cut progressively deeper into each block, the spacers between the blades of the successive blade rows are progressively reduced in radius to provide the necessary clearance for the block such that the sides of the cuts, along with the radially shrinking spacers, laterally stabilize the blades.

As noted above, the present apparatus divides the block by deforming or embossing the block rather than just slicing into it such that the block material opposite the blades is actually displaced to the sides of the cuts. Resultantly, as the block encounters each row of blades, it is expanded laterally. Now in order for the blades in the next row of blades to be in alignment with the cuts produced by the preceding row or rows of blades, the spacing of the blades in the succeeding row must be increased to accommodate the lateral expansion of the block as it passes through the apparatus.

As will be seen, the apparatus for practicing the method described herein utilizes identical razor-like cutting blades having an ordinary shape and peripheral edge and which require no rotary driving mechanism. Therefore, the apparatus is relatively inexpensive to make and maintain. Therefore, it should find wide application wherever it is desired to divide blocks of deep-frozen food product into smaller portions on a high volume basis.

BRIEF DESCRIPTION OF THE DRAWINGS

For a fuller understanding of the nature and objects of the invention, reference should be had to the following detailed description taken in connection with the accompanying drawings, in which.

DESCRIPTION OF THE PREFERRED EMBODIMENTS

Figure 1:
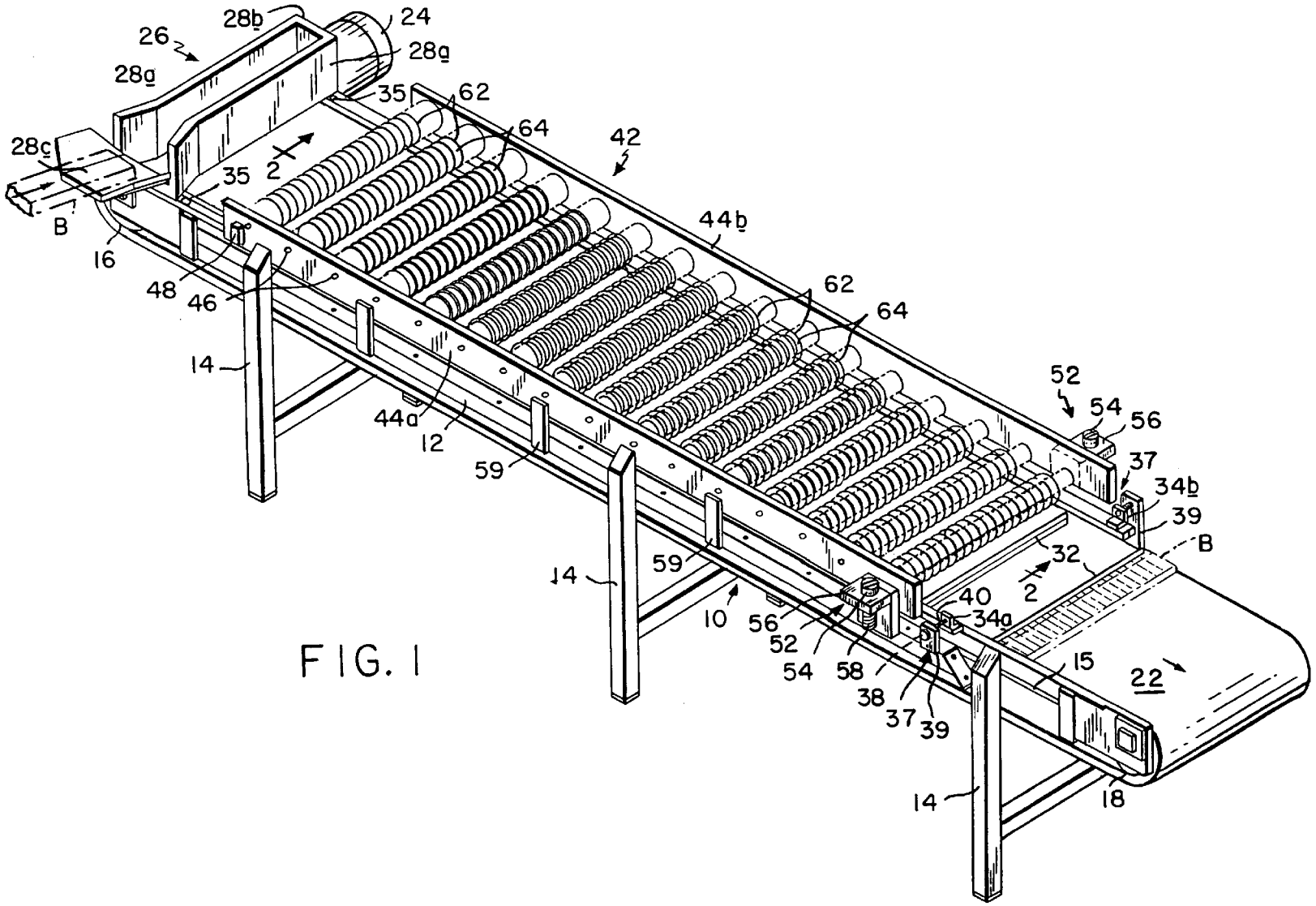
FIG. 1 is a perspective view of apparatus for dividing blocks of deep-frozen food product in accordance with the invention.

Referring to FIG. 1 of the drawings, our apparatus for dividing blocks of deep frozen food product, e.g., fish, comprises an elongated generally horizontal support frame shown generally at 10 including opposite side members 12 supported from below at spaced-apart locations along their lengths by leg assemblies 14. A support surface 15 extends between the side members 12.

Rotatably supported between side members 12 at opposite ends of support frame 10 is a pair of rollers 16 and 18. An endless conveyor belt 22 is engaged around rollers 16 and 18 such that an upper stretch of the belt extends long above support surface 15 and a lower belt stretch extends under that support surface as shown in FIG. 1. At least one of the rollers, herein roller 16, is rotated by suitable means such as an electric motor 24 mounted to frame 10 so as to advance the upper belt stretch toward the right as viewed in FIG. 1.

Mounted to the side members 12 at the left or entrance end of support frame 10 above belt 22 is a hopper or magazine 26 by which successive deep-frozen fish blocks B shown in phantom in FIG. 1 may be deposited onto conveyor belt 22. In the FIG. 1 apparatus, the magazine comprises a rectangular enclosure sized to receive the blocks and oriented perpendicular to the direction of travel of conveyor belt 22. The enclosure includes of a pair of side walls 28*a* and end wall 28*b* and a tray 28*c* is present at the open end of the enclosure on which blocks may be slid into the enclosure so as to properly orient the block relative to the conveyor belt. Thereupon, the inserted block drops through the open bottom of the enclosure onto the belt.

As the blocks are deposited onto the conveyor belt 22, they are engaged from behind by drivers 32 mounted to the working surface of the belt at spaced apart locations therealong. Drivers 32 extend substantially the full width of the belt and are oriented perpendicular to the direction of belt travel so that the drivers assure a similar orientation of the blocks deposited onto the belt.

Figure 2:
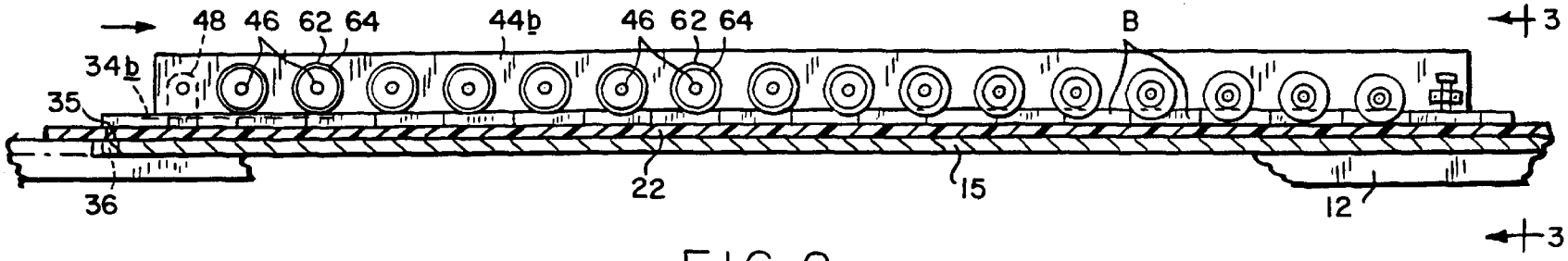
FIG. 2 is a sectional view taken along line 2—2 of FIG. 1.
Figure 3:
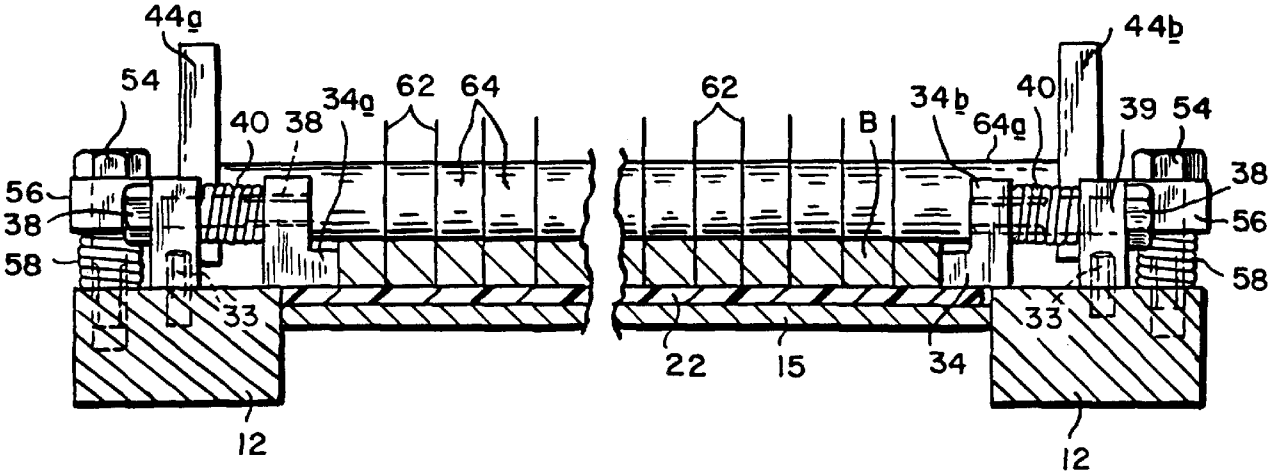
FIG. 3 is a sectional view along line 3—3 of FIG. 2.

Referring to FIGS. 1 to 3, in order to maintain the lateral positions of the blocks B on conveyor belt 22, rails 34*a* and 34*b* may be provided outboard opposite edges of the upper stretch of the belt. The left ends of rails 34*a* and 34*b* are pivotally connected to the underlying side members 12 by pivot pins 35 which extend down into vertical holes 36 present in the tops of side members 12. The opposite ends of rails 34*a* and 34*b* may be moved toward and away from the opposite edges of the upper stretch of conveyor belt 22 by adjustment mechanisms shown generally at 37. Each mechanism 37 comprises an adjustment screw 38 which passes through an ear 39 (FIG. 3) and is threaded into the associated rail 34*a* or 34*b*. The ear 39 extends up from the underlying side member 12 and is attached thereto by fastener 33. Coil springs 40 encircle screws 38 between rails 34*a*, 34*b* and ear 39 so that the rails are biased toward the edges of conveyor belt 22. Thus, the spacing of the rails can be adjusted to accommodate blocks B of somewhat different lengths.

Referring to FIGS. 1 and 2, mounted to support 10 above conveyor belt 22 is a cutting assembly shown generally at 42. Assembly 42 comprises a pair of spaced-apart side walls 44*a* and 44*b* which rotatably support the opposite ends of a succession of arbors 46. The illustrated apparatus has sixteen such arbors 46 suspended between side walls 44*a* and 44*b* at equally spaced apart locations along the lengths of those walls. The ends of the walls 44*a* and 44*b* adjacent to magazine 26 are pivotally mounted to brackets 48 extending up from the two side members 12 of support 10. The opposite ends of side walls 44*a* and 44*b* can be moved up and down to some extent relative to support 10 by a pair of screw adjustments shown at 52.

As best seen in FIG. 3, each adjustment 52 consists of an adjustment screw 54 which extends down through a vertical passage in an ear 56 projecting out from the side of side wall 44*a* or 44*b*, the screw being threaded into the top of the underlying side member 12. Coil springs 58 encircle screws 54 between ears 56 and the underlying members 12 so that the right end of assembly 42 is biased upwardly. Thus, cutting assembly 42 may be moved toward and away from conveyor belt 22 by turning screws 54 in one direction or the other. Preferably, brackets 59 extend up from side members 12 just outboard the side walls 44*a* and 44*b* of cutting assembly 42 to minimize lateral motion of that assembly.

Referring now to FIGS. 1 to 3, each arbor 46 carries a plurality of discoid razor-like blades 62 separated by cylindrical spacers 64 so that the gaps between the blades are more or less equal. Preferably, all of the blades 62 have the same diameter. However, the successive arbors are mounted to the side walls 44*a* and 44*b* so as to position the successive rows of blades 62 progressively closer to conveyor belt 22. Thus, the blades 62 on the first or left- most arbor 46 in FIG.

1 are spaced from the conveyor belt 22 a distance slightly less than the thickness of the blocks B being divided by the apparatus. The second arbor is positioned so that the blades on that arbor are located slightly closer to the conveyor belt than the blades on the first arbor, and so on to the last or right-most arbor in FIG. 1 whose blades are located right at the upper surface of belt 22. The portions of that surface opposite those blades may be relieved as needed to avoid being cut by the blades.

The individual blades should make shallow cuts in the block, i.e., no more than about 0.62 inch deep for cold-frozen fish at 0° F. In the illustrated apparatus, the blades on each succeeding arbor are about 0.030 in. closer to conveyor belt 22 than the blades on the previous arbor. The apparatus has sixteen arbors 46 and sixteen blade rows, each row having nineteen blades so that if the blades on the first arbor make a 0.030 inch cut in a block B passing through the apparatus, the last row of blades will effect a division of that block into twenty portions.

It should also be apparent from FIGS. 1 and 2 that the spacers 64 on the successive arbors have progressively smaller diameters. In fact, the successive rows of spacers are progressively smaller in an amount by which the successive rows of blades cut into the blocks B. In other words, the spacers are dimensioned to provide the maximum amount of support and lateral stability to the successive rows of blades 62.

Figure 4:
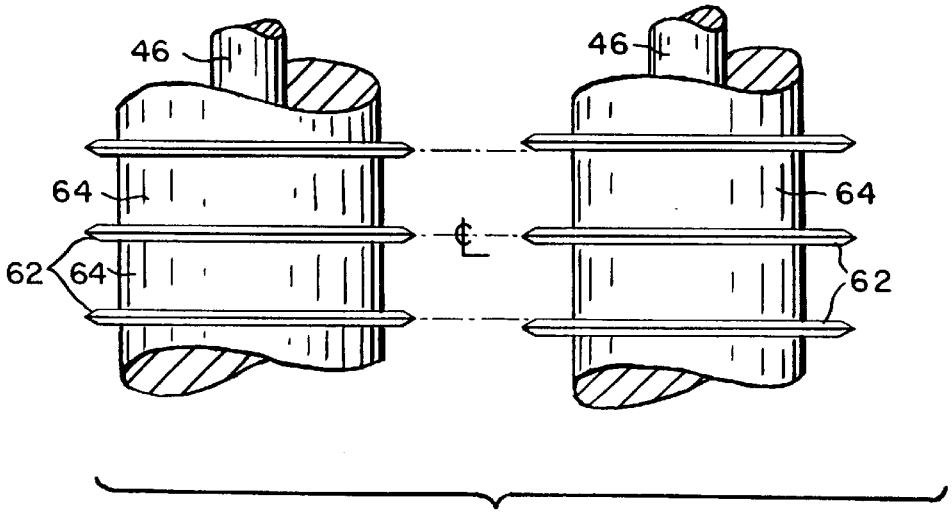
FIG. 4 is a fragmentary view on a still larger scale showing adjacent rows of cutting blades in the FIG. 1 apparatus.

As noted previously, when each blade 62 engages a block B, it makes a very shallow cut. In fact, since there is substantially no relative linear movement of the block and blade, the cut is made, not by removing material from the block as with a conventional cutting or slicing action, but rather by displacing the block material to the sides of the cut. In other words, the process is more akin to an embossing of the block with a very thin embossing die. This displacement of the block material to the sides of the cuts made by each row of blades results in an extension or elongation of the block laterally in the order of one-half inch (i.e., 0.030 in.×19 blades) as it passes under each row of blades. Consequently, if steps are not taken, the cuts made by a particular row of blades will not line up with the succeeding row of blades. This is illustrated in FIG. 4 which shows two adjacent rows of blades 62 and their spacers 64 mounted to the associated arbors 46. The blades illustrated are those at and adjacent to the longitudinal center line C/L of the FIG. 1 apparatus. The dimensions of the various elements in FIG. 4 are exaggerated for clarity. For example, the blades 62 are shown as being quite thick whereas, in reality, they are more or less like discoid razor blades.

As seen from FIG. 4, the middle blades 62 in the two blade rows are aligned more or less with the machine center line C/L. However, the outboard blades 62 in the second row of blades are spaced further from the middle blade 62 in that row than are the outer blades spaced from the middle blade of the first blade row, the difference being exaggerated for clarity. Consequently, when a block B extends or expands laterally after being subjected to the first row of blades, the cuts therein will be aligned with the blades 62 of the second row of blades. In like manner, the blades of the next row of blades (not shown) will be spaced further apart than the blades of the second row to accommodate the extension of the block caused by the second row of blades, and so on.

Thus, the progressively wider spacing of the blades 62 in the successive rows of blades in cutting assembly 42 assures that the corresponding blades in all of the blade rows will follow the same cut lines so that the efficiency of the dividing process is maximized and product wastage is minimized.

During normal operation of the FIG. 1 apparatus, the motor 24 is turned on so that the upper stretch of conveyor belt 22 advances toward the right. Since the dimensions of blocks B may vary slightly from lot to lot, a first or test block B may be loaded into the magazine 26 and deposited on the conveyor belt 22 which thereupon advances the block under the successive rows of blades 62. The motion of that block along the apparatus may be observed and if the block has too much or too little lateral play on the conveyor, the adjustment screws 38 may be adjusted to move the rails 34*a* and/or 34*b* toward or away from the conveyor until the block moves smoothly through the apparatus.

Similarly, adjustment screws 52 may be turned to adjust the cutting assembly 42 up or down as needed so that the blades in the first row of blades only cut about 0.030 inch into the block and the blades in the last row of blades cut through the bottom of the block.

After that, blocks B can be fed one after the other into magazine 26 whereupon they will be deposited onto belt 22 in turn and transported under the successive rows of blades. The individual pieces resulting from the dividing process that arrive at the exit end of the apparatus may be deposited onto another conveyor belt (not shown) and conducted to another similar dividing apparatus or to a breading or other work station.

In the FIG. 1 apparatus, the blocks B are moved through the apparatus on a moving conveyor belt 22. However, other means for conveying the blocks through the apparatus are possible. For example, in lieu of belt 22, the support frame may utilize a plurality of parallel chains passing around sprockets at opposite ends of the apparatus as disclosed in the above U.S. Pat. No. 2,941,560, the contents of which is hereby incorporated herein by reference. This allows any debris to drop down away from the blades 62.

Figure 5:
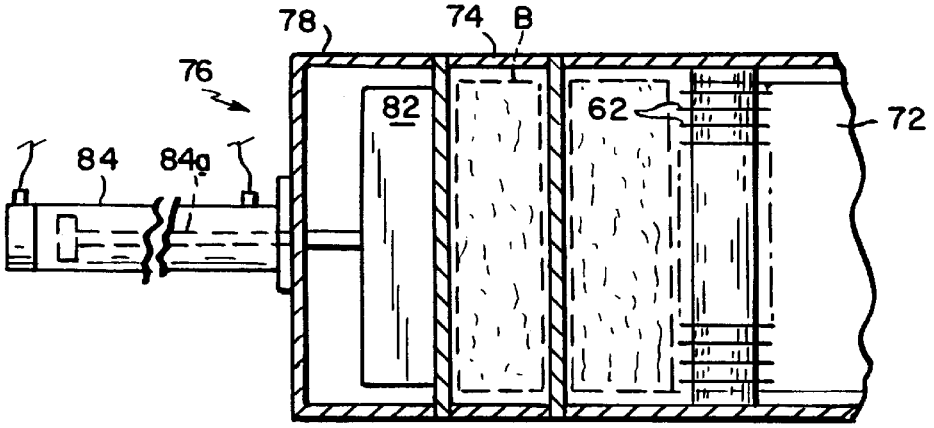
FIG. 5 is a plan view with parts cut away illustrating an alternative block feeder for the FIG. 1 apparatus.
Figure 6:
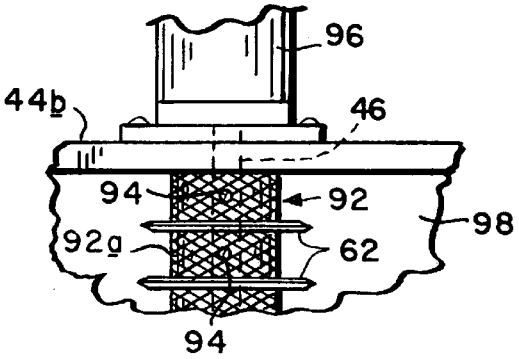
FIG. 6 is a fragmentary plan view showing still another means for feeding the blocks through the apparatus.

FIG. 5 illustrates a technique for feeding the blocks B through the apparatus using the blocks themselves. In the FIG. 5 apparatus, the conveyor belt 22 is substituted for by a stationary support surface 72 and the magazine 26 is replaced by a generally rectangular hopper 74 open at the top and bottom and sized to accommodate blocks B dropped into the hopper from above. Positioned to the left of hopper 74 is a pushing assembly shown generally at 76. Assembly 76 includes a housing 78 which slidably supports a pusher blade 82 adjacent to the bottom of hopper 74. Blade 82 may be reciprocated by a double acting piston 84 mounted to housing 78 and whose rod 84*a* is connected to blade 82. When the piston rod 84*a* is in its retracted position shown in FIG. 5, blade 82 is located entirely within housing 78. On the other hand, when rod 84*a* is extended, blade 82 is moved into hopper 74 through a slot in the bottom of the hopper. Thus, the lowermost block B present in hopper 74 will be pushed from the hopper through a slot in the bottom of the hopper onto the surface 72. Thereupon, the piston rod 84*a* and blade 82 may be moved to the retracted position which allows another block B to drop to the bottom of hopper 74. A subsequent extension of the piston rod 84*a* will push that block from hopper 74 which block will, in turn, push the previous block further along surface 72. Thus by adding additional blocks to hopper 74 and cycling blade 82 between its extended and intracted positions, a succession of blocks B can be deposited on surface 72 with each block advancing the ones before it along the surface past the successive rows of cutting blades 62.

Also, while the illustrated apparatus has the cutting assembly 42 located above the blocks B being divided, it is also possible to position the cutting assembly below the blocks in which case the block transport system would be located above the blocks. Actually, rows of cutting blades may be provided both above and below the blocks as disclosed in the above U.S. Pat. No. 2,941,560 so that the blocks are cut from above and below at the same time.

Additional rows of blades may be added at the right or exit end of the FIG. 1 apparatus, with the blades in those rows having progressively increased width and spacing so that, following completion of the block dividing process as described above, the individual pieces resulting from the process will be separated from one another in preparation for subsequent conveyorized batter and breading operations.

In some applications, it may be desirable to use the spacers on one or more of the arbors 46 to advance or help to advance the blocks B through the apparatus. For example, the arbors 46 at the left end segment of the apparatus may be provided with spacers 92 fitted with set screws 94 that engage the arbor so that the spacers rotate with the arbors. Those arbors may be rotated by motor means 96 at a relatively low speed. Preferably, the spacers have knurled peripheral surfaces 92*a* so that when a block B is fed under the spacers, e.g. by hand, the rotating spacers will engage and advance the block (and any previous blocks) along the support surface 98. The blades 62 between the spacers, which are not rotatably fixed to the arbor 46, will divide the block in more or less the same way described above in connection with the FIG. 1 apparatus.

It will appreciated from the foregoing that our apparatus will divide blocks of deep-frozen food product into individual pieces quite efficiently and with minimum product wastage. Further, the apparatus should be able to operate for a prolonged period with minimum maintenance so as to maximize product throughput.

It will thus be seen that the objects set forth above, among those made apparent from the preceding description, are efficiently attained and, since certain changes may be made in carrying out the above process and in the constructions set forth without departing from the scope of the invention. For example, all of the arbors may be spaced the same distance from belt 22 and the blades 62 in the successive rows may have progressively larger diameters, albeit with a cost sacrifice. Therefore, it intended that all the matter contained in the above description or shown in the accompanying drawings shall be interpreted as illustrative and not in a limiting sense.

It will also be understood that the following claims are intended to cover all of the generic and specific features of the invention described herein.

What is claimed is:

1. In an apparatus for dividing deep-frozen food blocks which apparatus includes a surface for supporting the blocks, a succession of spaced, parallel blade rows, each row including a plurality of spaced, parallel discoid blades having a common axis, wherein the blades in each row are closer to said surface than the blades in the previous blade row, and wherein each of the blades in each row is generally aligned with a respective one of the blades in the previous row, and moving means for advancing successive blocks past the succession of blade rows so that the blades in the succession of blade rows form progressively deeper grooves in the blocks, the improvement wherein the blades in each row are undriven and free to rotate about said axis so that there is minimal relative linear motion the blades and the blocks in the advancing direction, whereby the blades groove the blocks by displacing block material to the sides of the groove rather than by removing block material, and wherein cylindrical spacers are positioned between the blades in each blade row coaxial to those blades, the spacers in each blade row having equal diameters, and the diameters of the spacers in each blade row being smaller than the diameters of the spacers in the previous blade row.

2. The apparatus defined in claim 1 wherein the spacers in each blade row are axially longer than the spacers in the previous blade row.

3. In an apparatus for dividing deep-frozen food blocks which apparatus includes a surface for supporting the blocks, a succession of spaced, parallel blade rows, each row including a plurality of spaced, parallel discoid blades having a common axis, wherein the blades in each row are closer to said surface than the blades in the previous blade row, and wherein each of the blades in each row is generally aligned with a respective one of the blades in the previous row, and moving means for advancing successive blocks past the succession of blade rows so that the blades in the succession of blade rows form progressively deeper grooves in the blocks, the improvement wherein the blades in each row are separated by spacers positioned between the blades coaxial to those blades, and wherein the spacers in each blade row are axially longer than the spacers in the previous row so that the blades are spaced farther apart than the blades of the previous blade row and are undriven and free to rotate about said axis so that there is minimal relative linear motion between the blades and the blocks in the advancing direction, whereby the blades groove the blocks by displacing block material to the sides of the groove rather than by removing block material.

4. The apparatus defined in claim 3 wherein said blades have equal diameters.

5. The apparatus defined in claim 3 and further including a magazine positioned ahead of the succession of blade rows for feeding a succession of blocks to the moving means.

6. The apparatus defined in claim 3 wherein the moving means comprise a conveyor;

means on the conveyor for engaging the blocks from behind, and motive means for advancing the conveyor to move a surface of the conveyor relative to the succession of blade rows.

7. The apparatus defined in claim 6 wherein the conveyor supports the blocks from below and the succession of blade rows is spaced above the conveyor.

8. Apparatus for dividing deep-frozen food blocks comprising:

a support surface;

cutting means positioned above the support surface, said cutting means including a series of spaced-apart arbors, said arbors having parallel axes, mounting means for mounting the arbors in the series so that the axis of each successive arbor is progressively closer to said surface than the axis of the previous arbor, a plurality of discoid blades spaced coaxially along each arbor and being free to rotate about the axis of that arbor, wherein each of the blades in each row is generally aligned with a respective one of the blades in the previous row, a plurality of cylindrical spacers positioned between the blades on each arbor, the spacers on each successive arbor in the series being axially longer than the spacers on the previous arbor in the series so that the blades in each row are spaced farther apart than the blades of the previous row, and the diameter of the spacers on each successive arbor in the series being less than the diameter of the spacers on the previous arbor in the series;

means for moving blocks in succession past the blades on the series of arbors, and means for adjusting the spacing of the cutting means from the support surface so that while the blades on each arbor make shallow cuts in each of the blocks, the blades on the entire series of arbors divide each of the blocks into a plurality of parts.

9. The apparatus defined in claim 8 wherein the means for moving comprise a conveyor under the cutting means, and means for advancing said conveyor to move a surface of the conveyor relative to the cutting means.

* * * * *